US009793072B2

(12) United States Patent
Watanabe et al.

(10) Patent No.: US 9,793,072 B2
(45) Date of Patent: Oct. 17, 2017

(54) PUSH SWITCH AND SWITCH MODULE

(71) Applicants: CITIZEN ELECTRONICS CO., LTD., Yamanashi (JP); CITIZEN HOLDINGS CO., LTD., Tokyo (JP)

(72) Inventors: Shinsuke Watanabe, Yamanashi (JP); Satoshi Okuma, Yamanashi (JP)

(73) Assignees: CITIZEN ELECTRONICS CO., LTD., Yamanashi (JP); CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 14/786,799

(22) PCT Filed: Apr. 25, 2014

(86) PCT No.: PCT/JP2014/061774

§ 371 (c)(1),
(2) Date: Oct. 23, 2015

(87) PCT Pub. No.: WO2014/175446

PCT Pub. Date: Oct. 30, 2014

(65) Prior Publication Data

US 2016/0071665 A1 Mar. 10, 2016

(30) Foreign Application Priority Data

Apr. 26, 2013 (JP) ..... 2013-094409

(51) Int. Cl.
*H01H 1/10* (2006.01)
*H01H 13/50* (2006.01)
(Continued)

(52) U.S. Cl.
CPC ..... *H01H 13/50* (2013.01); *H01H 13/10* (2013.01); *H01H 13/48* (2013.01); *H01H 13/52* (2013.01);
(Continued)

(58) Field of Classification Search
CPC ..... H01H 13/50; H01H 13/80; H01H 13/10; H01H 13/52
(Continued)

(56) References Cited

U.S. PATENT DOCUMENTS 8,212,160 B2 * 7/2012 Tsao ..... H01H 13/64 200/1 B
8,803,016 B2 * 8/2014 Kang ..... H01H 13/704 200/314
(Continued)

FOREIGN PATENT DOCUMENTS

JP S57-197133 U 12/1982
JP S60-060849 U 4/1985
(Continued)

OTHER PUBLICATIONS

International Seatrch Report for PCT/JP2014/061774, dated Jul. 1, 2014.
(Continued)

*Primary Examiner* — R S Luebke
*Assistant Examiner* — Lheiren Mae A Caroc

(57) ABSTRACT

Provided are a switch module and a push switch that have a soft sensation when pressed. A push switch and a switch module have a substrate, a first fixed contact point disposed on the substrate surface, a second fixed contact point disposed around the first fixed contact point on the substrate surface, a convex dome-shaped upper spring disposed on the substrate surface so that an end part is in contact with the second fixed contact point, the upper spring being pressed so as to invert the dome shape and to establish conduction between the first fixed contact point and the second fixed contact point, and a lower spring disposed below the upper spring, the lower spring adjusting the operation load applied to the upper spring during inversion of the dome shape.

8 Claims, 13 Drawing Sheets

(51) Int. Cl.

| | |
|---|---|
| ***H01H 13/52*** | (2006.01) |
| ***H01H 13/10*** | (2006.01) |
| ***H01H 13/80*** | (2006.01) |
| ***H01H 13/48*** | (2006.01) |
| ***H01H 13/85*** | (2006.01) |

(52) U.S. Cl.
CPC ..... *H01H 13/80* (2013.01); *H01H 13/85* (2013.01); *H01H 2215/002* (2013.01); *H01H 2215/004* (2013.01); *H01H 2215/008* (2013.01); *H01H 2221/036* (2013.01); *H01H 2221/05* (2013.01)

(58) Field of Classification Search
USPC ..... 200/515, 516
See application file for complete search history.

(56) References Cited

U.S. PATENT DOCUMENTS

| | | | |
|---|---|---|---|
| 2003/0116419 | A1 | 6/2003 | Anzai |
| 2004/0026222 | A1 | 2/2004 | Adachi |
| 2013/0087443 | A1 | 4/2013 | Kikuchi |

FOREIGN PATENT DOCUMENTS

| | | | |
|---|---|---|---|
| JP | H05-043436 | U | 6/1993 |
| JP | 2004-031185 | A | 1/2004 |
| JP | 2004-079220 | A | 3/2004 |
| JP | 2004-111148 | A | 4/2004 |
| JP | 2007-200737 | A | 8/2007 |
| JP | 2012-064530 | A | 3/2012 |
| KR | 10-2012-0029989 | A | 3/2012 |

OTHER PUBLICATIONS

International Preliminary Report on Patentability for PCT/JP2014/061774, dated Oct. 26, 2015.
State Intellectual Property Office of the People's Republic of China, Office Action for Chinese patent application No. 201480023769.3, dated Oct. 26, 2016.
Korean Intellectual Property Office, Office Action for KR Patent Application No. 10-2015-7032370, dated Mar. 7, 2017.
European Patent Office, Office Action for EP Patent Application No. 14788222.9, dated Mar. 14, 2017.

* cited by examiner

PUSH SWITCH AND SWITCH MODULE

TECHNICAL FIELD

The present invention relates to a push switch and a switch module.

BACKGROUND ART

Push switches are known as button switches used in, for example, portable and on-board audio devices and digital camera VTRs and mobile communication devices such as cellular phones.

FIG. 15 is a sectional view illustrating a push switch 100 described in Patent Literature 1.

The push switch 100 includes a substrate 101, a movable member 102, a first pressing member 103, a second pressing member 104, a housing 105, a first fixed contact point 106, and second fixed contact points 107.

The substrate 101 includes a recess formed in its surface, the first fixed contact point 106 is disposed at the center of the recess, and the second fixed contact points 107 are disposed around the recess. The movable member 102 is a dome-shaped flexible conductive member, and is disposed so that its end parts are in contact with the second fixed contact points 107. The first pressing member 103 is a resin sheet member forming two connected disks having different diameters. The second pressing member 104 is a hemispherical member made of a synthetic resin. The bottom surface of the second pressing member 104 is bonded to the lower surface of the first pressing member 103, and the top of the spherical surface of the second pressing member 104 is in contact with the top of the movable member 102. The housing 105 is bonded to the upper part of the substrate 101 to form, together with the recess in the substrate 101, a space for accommodating the movable member 102, the lower part of the first pressing member 103, and the second pressing member 104.

When the upper surface of the first pressing member 103 is pressed, the curve of the movable member 102 is inverted so that the central portion, including the top, of the movable member 102 comes into contact with the first fixed contact point 106. When the top of the movable member 102 comes into contact with the first fixed contact point 106, the first fixed contact point 106 and the second fixed contact points 107 establish conduction between them via the movable member 102.

When the upper surface of the first pressing member 103 is pressed, the movable member 102 functions as a spring which generates a spring load acting opposite to a force that presses the upper surface of the first pressing member 103. Upon pressing of the upper surface of the first pressing member 103, the spring load of the movable member 102 that acts opposite to the pressing direction produces a sense of click.

Patent Literature 2 discloses a thin switch capable of ensuring a sufficient stroke length in switch operation and improving a feeling upon switch operation. The thin switch described in Patent Literature 2 includes a surface sheet, a dome sheet, a movable contact point, a fixed contact point, a spacer, and an elastic member. The dome sheet includes a dome portion bulging in a dome shape. The movable contact point is disposed on the lower surface of the dome portion. The fixed contact point is opposed to the movable contact point. The spacer opposes the lower surface of the surface sheet to the upper surface of the dome portion. The elastic member is interposed between the lower surface of the surface sheet 2 and the upper surface of the dome portion, and elastically deforms earlier than the dome portion for a pressing load received by the upper surface of the surface sheet.

CITATION LIST

Patent Literatures

Patent Literature 1: Japanese Laid-open Patent Publication No. 2004-79220

Patent Literature 2: Japanese Laid-open Patent Publication No. 2004-31185

SUMMARY (a) and (b) of FIG. 16 illustrate graphs each for explaining the relationship between the operation load applied to the push switch 100 and the amount of deformation (stroke) of the movable member 102. Referring to each graph, the ordinate represents the operation load (P) and the abscissa represents the stroke (S).

(a) of FIG. 16 is a graph representing an operation load applied to only the movable member 102. Upon pressing of the first pressing member 103, the operation load initially increases with increasing stroke. When the movable member 102 deforms by a distance s1 in the direction to press, the curve of the movable member 102 is inverted and the operation load involved in deformation starts to decrease. When the movable member 102 further deforms up to a distance s2, the movable member 102 has been inverted completely. Thereafter, the operation load involved in further deforming the movable member 102 increases.

(b) of FIG. 16 is a graph when the movable member 102 is hindered by the substrate 101 from deforming. This is the case where when the curve of the movable member 102 is inverted and the movable member 102 then deforms up to a distance s3, the movable member 102 comes into contact with the substrate 101. In this case, because the movable member 102 can no longer deform toward the substrate 101, the operation load rapidly increases with a change in stroke.

When the operation load rapidly increases in a manner depicted in (b) of FIG. 16, the operator of the push switch 100 may feel as if his or her finger were halted upon pressing of the push switch 100 with his or her finger, failing to experience a preferable sensation.

It is an exemplary object of the present invention to provide a push switch and a switch module in order to solve the above-mentioned problem. It is another exemplary object of the present invention to provide a push switch and a switch module that have a soft sensation when pressed.

Provided is a push switch including a substrate, a first fixed contact point disposed on a surface of the substrate, a second fixed contact point disposed around the first fixed contact point on the surface of the substrate, a convex dome-shaped movable member disposed on the surface of the substrate so that an end part of the movable member is in contact with the second fixed contact point, the movable member being pressed so as to invert the dome shape and thereby establish conduction between the first fixed contact point and the second fixed contact point, and a buffer member disposed above or below the movable member, the buffer member adjusting an operation load applied to the movable member during inversion of the dome shape.

Preferably, in the above push switch, the buffer member is a leaf spring interposed between the substrate and the movable member to cover the first fixed contact point.

Preferably, in the above push switch, the buffer member is conductive rubber mounted on the substrate to cover the first fixed contact point.

Preferably, in the above push switch, the substrate includes one of a through hole and an indentation in a portion with which the movable member comes into contact upon the inversion of the dome shape, the first fixed contact point is disposed around the one of the through hole and the indentation, and the buffer member is a leaf spring mounted on the substrate to cover the first fixed contact point and the one of the through hole and the indentation.

Preferably, the above push switch further includes an elastic protective sheet which covers the movable member.

Preferably, in the above push switch, the buffer member is an elastic protective sheet which covers the movable member.

Preferably, in the above push switch, the buffer member adjusts a change in the operation load for an amount of deformation of the movable member after establishment of the conduction between the first fixed contact point and the second fixed contact point.

Provided is a switch module including a common substrate, and a plurality of switch structures formed on the common substrate, the plurality of switch structures each including a first fixed contact point disposed on a surface of the common substrate, a second fixed contact point disposed around the first fixed contact point on the surface of the common substrate, a convex dome-shaped movable member disposed on the surface of the common substrate so that an end part of the movable member is in contact with the second fixed contact point, the movable member being pressed so as to invert the dome shape and thereby establish conduction between the first fixed contact point and the second fixed contact point, and a buffer member disposed above or below the movable member, the buffer member adjusting an operation load applied to the movable member during inversion of the dome shape.

According to the above push switch and switch module, it is possible to provide a push switch that has a soft sensation when pressed.

DESCRIPTION

Hereinafter, with reference to the drawings, a switch module and a push switch according to the present invention will be explained in detail. However, it should be noted that the technical scope of the present invention is not limited to embodiments thereof and includes the invention described in claims and equivalents thereof.

Figure 1:
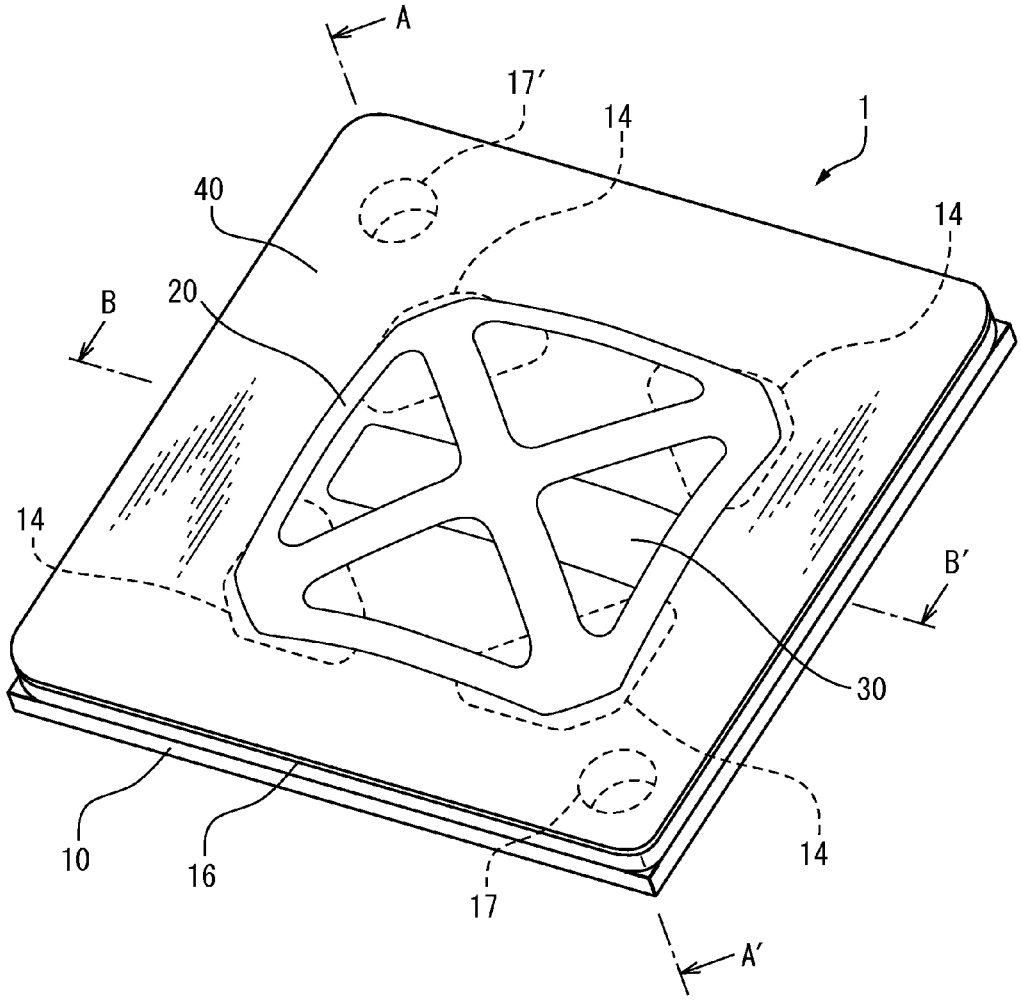
FIG. 1 is a perspective view illustrating a push switch 1.
Figure 2:
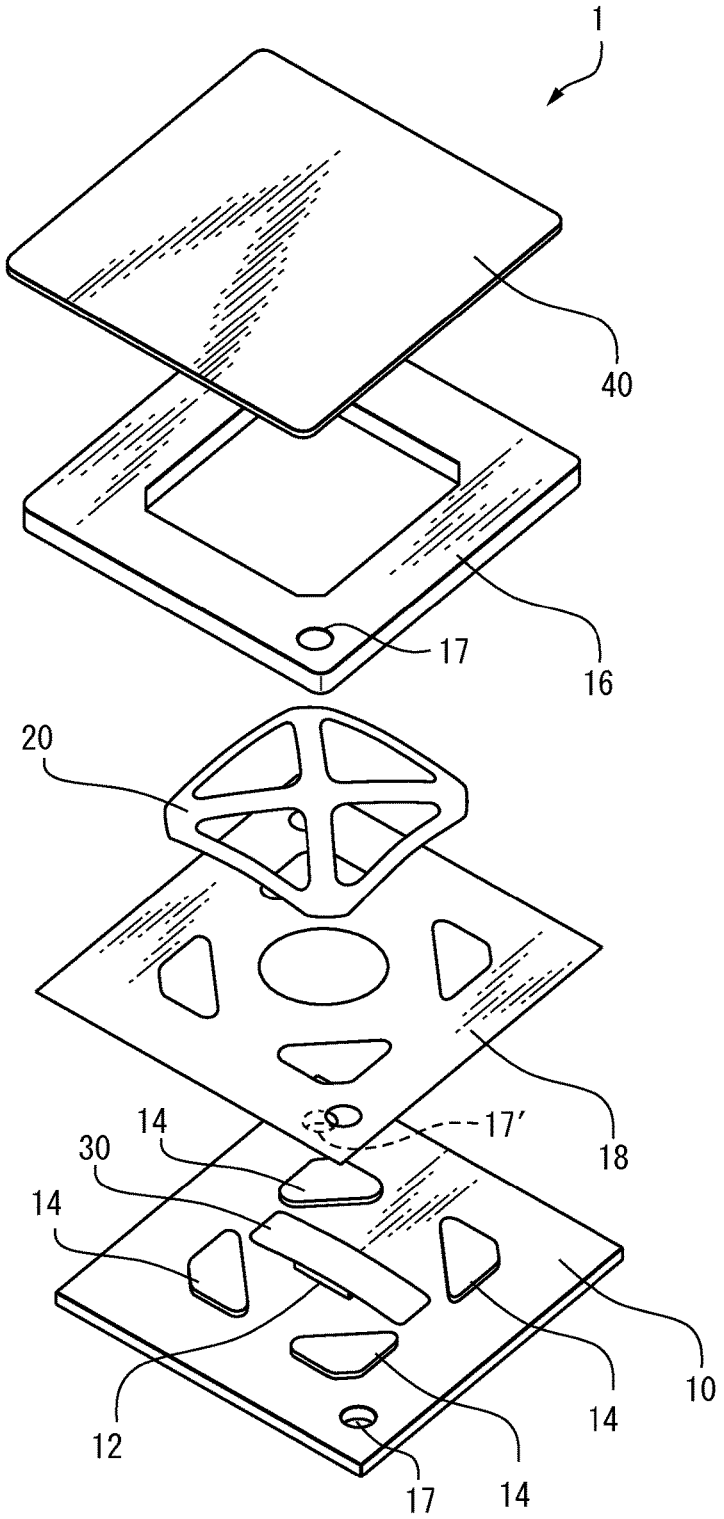
FIG. 2 is an exploded perspective view of the push switch 1.
Figure 3:
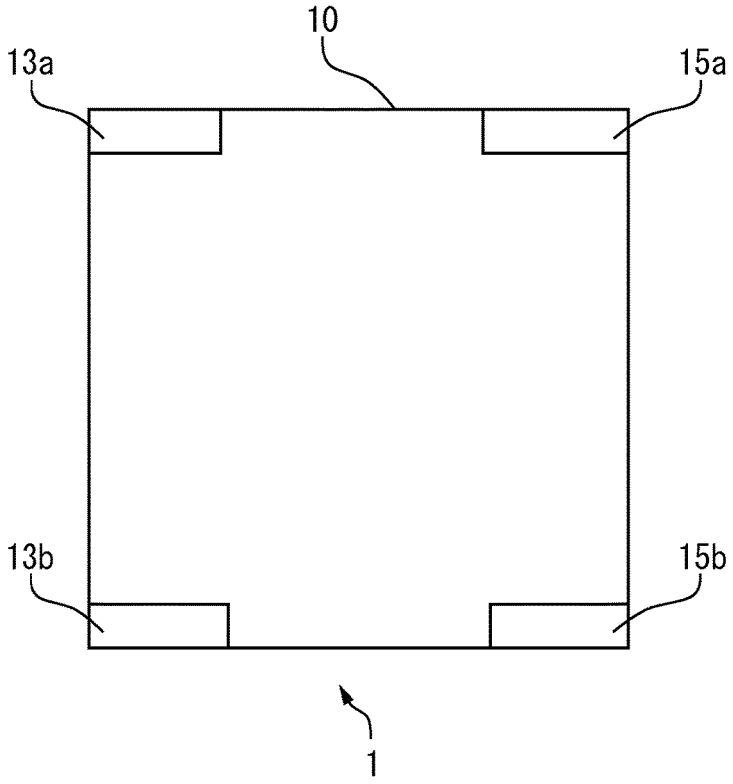
FIG. 3 is a bottom view of the push switch 1.
Figure 4:
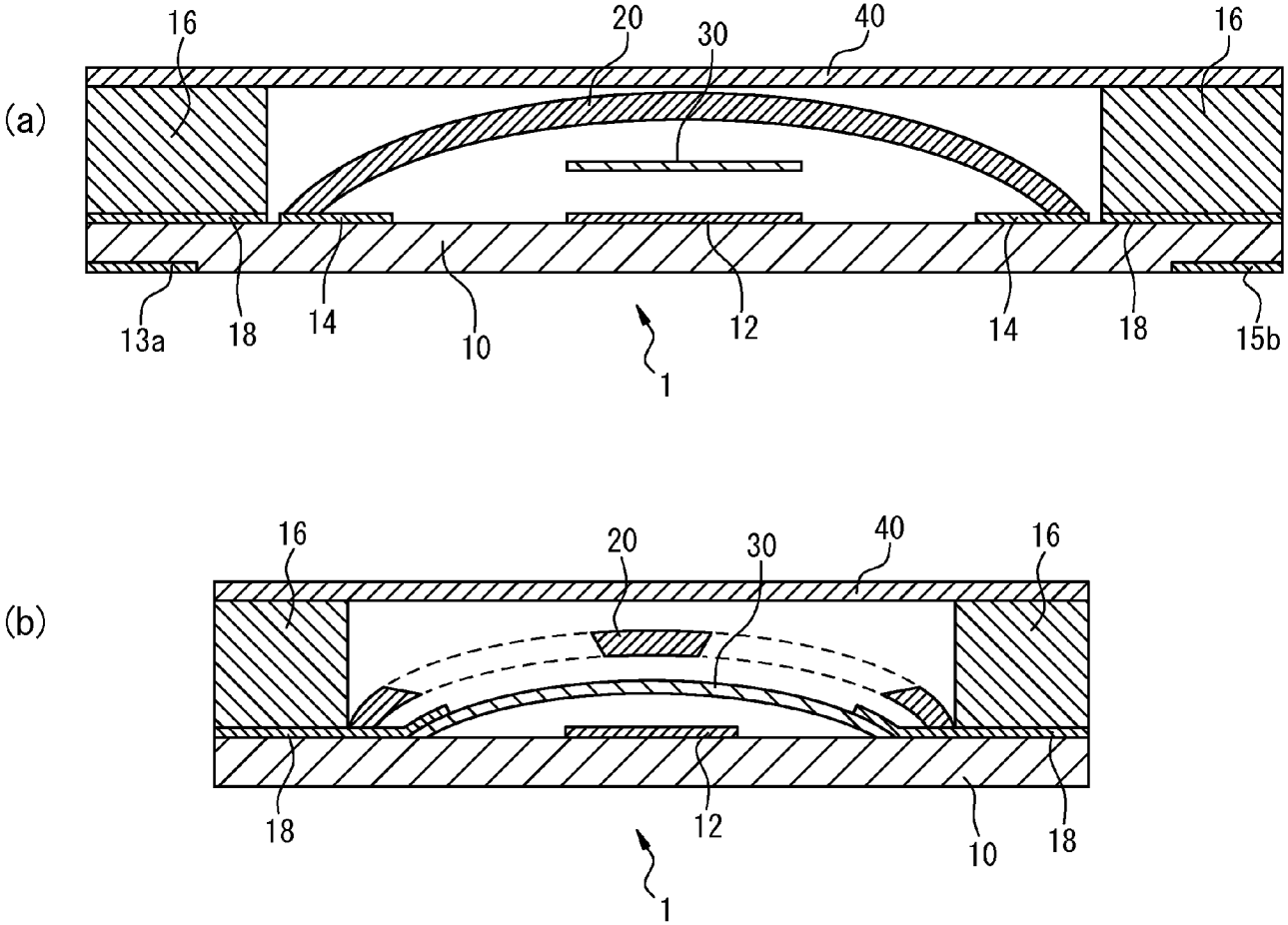
FIG. 4 illustrates in (a), a sectional view of the push switch 1 taken along a line A-A' shown in FIG. 1, and in (b), a sectional view of the push switch 1 taken along a line B-B' shown in FIG. 1.

FIG. 1 is a perspective view illustrating a push switch 1, FIG. 2 is an exploded perspective view of the push switch 1, and FIG. 3 is a bottom view of the push switch 1. FIG. 4 illustrates in (a), a sectional view of the push switch 1 taken along a line A-A' shown in FIG. 1, and in (b), a sectional view of the push switch 1 taken along a line B-B' shown in FIG. 1.

The push switch 1 includes a substrate 10, a mold frame 16, an adhesive sheet 18, an upper spring 20, a lower spring 30, and a protective sheet 40.

A first fixed contact point 12 and second fixed contact points 14 are formed on the upper surface of the substrate 10. The first fixed contact point 12 is a conductor having a quadrate flat surface, and is disposed at the center of the upper surface of the substrate 10. Each second fixed contact point 14 is a conductor having a frame-shaped flat surface, and is disposed on the upper surface of the substrate 10 along the inner peripheral wall of the mold frame 16 so as to surround the first fixed contact point 12.

A pair of first electrodes 13*a* and 13*b* and a pair of second electrodes 15*a* and 15*b* are formed on the lower surface of the substrate 10, as illustrated as FIG. 3. An insulating sheet member made of an insulating synthetic resin is also disposed on the lower surface of the substrate 10. The pair of first electrodes 13*a* and 13*b* are electrically connected to the first fixed contact point 12 via a through-hole electrode and back wiring (neither is illustrated). The pair of second electrodes 15*a* and 15*b* are electrically connected to the second fixed contact points 14 via a through-hole electrode and back wiring (neither is illustrated).

The mold frame 16 is bonded to the upper surface of the substrate 10 through the adhesive sheet 18. The mold frame 16 is bonded to the substrate 10 so that the substrate 10 and the mold frame 16 form a space on the substrate 10 to accommodate the upper spring 20.

The upper spring 20 is a dome-shaped flexible conductive member, and is disposed on the substrate 10 so that its end parts are in contact with the second fixed contact points 14. Pressing the upper spring 20 inverts its dome shape to establish conduction between the first fixed contact point 12 and the second fixed contact points 14, and thereby turn on the switch. The upper spring 20 is made of, for example, stainless steel. The upper spring 20 exemplifies a movable member.

The upper spring 20 has not only a dome shape but also a cruciform shape defined by four triangular holes formed in it, as illustrated in FIGS. 1 and 2. This cruciform shape is advantageous in terms of setting a long stroke in pressing.

The lower spring 30 is an elongated flexible conductive member (leaf spring) interposed between the substrate 10 and the upper spring 20 to cover the first fixed contact point 12. The lower spring 30 is, for example, curved across the first fixed contact point 12, and adjusts the operation load applied to the upper spring 20 upon inversion of the dome shape of the upper spring 20. The lower spring 30 deforms so that its curve is crushed due to the load acting on it, but not inverted, unlike the upper spring 20. The two ends of the lower spring 30 are fixed to the substrate 10 by the adhesive sheet 18. The lower spring 30 is made of, for example, stainless steel. The lower spring 30 may be mounted on the first fixed contact point 12 to enable the switch to be turned on when the upper spring 20 and the lower spring 30 come into contact with each other. The lower spring 30 exemplifies a buffer member disposed below the movable member.

The protective sheet 40 is a flexible insulating resin sheet, and has its lower surface end parts bonded to the upper surface of the mold frame 16. The protective sheet 40 seals, together with the substrate 10 and the mold frame 16, a space for accommodating the upper spring 20. Although FIGS. 1 and 2 illustrate the protective sheet 40 as a transparent sheet, the protective sheet 40 may be nontransparent.

The substrate 10 and the mold frame 16 include two holes 17, and the adhesive sheet 18 includes two holes 17'. A combination of the holes 17 and 17' aligns the mold frame 16 and the adhesive sheet 18 with each other to assemble the push switch 1. The numbers of holes 17 and 17' each may not be two. Further, the substrate 10 and the mold frame 16 may be integrated with an insert mold, instead of bonding the substrate 10 to the mold frame 16 through the adhesive sheet 18.

Figure 5:
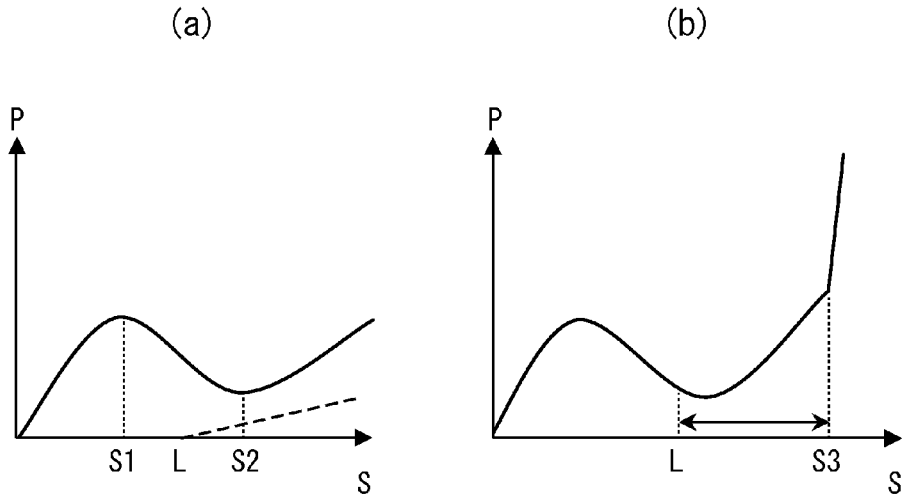
FIG. 5 illustrates, in (a) and (b), graphs each for explaining the relationship between the operation load applied to the push switch 1 and the amount of deformation (stroke) of the upper spring 20.

(a) and (b) of FIG. 5 illustrate graphs each for explaining the relationship between the operation load applied to the push switch 1 and the amount of deformation (stroke) of the upper spring 20. Referring to each graph, the ordinate represents the operation load (P) and the abscissa represents the stroke (S).

(a) of FIG. 5 represents the relationship between the operation load and the stroke for each of the upper spring 20 and the lower spring 30. Referring to this graph, a solid line indicates a curve for the upper spring 20 and a broken line indicates a curve for the lower spring 30. Upon pressing of the push switch 1, the operation load initially increases with increasing stroke. When the upper spring 20 deforms by a distance s1 toward the substrate 10, the curve of the upper spring 20 is inverted and the operation load involved in deformation starts to decrease. When the upper spring 20 further deforms up to a distance s2, the upper spring 20 has been inverted completely.

When the distance L between the upper spring 20 and the lower spring 30 satisfies L<s2, the upper spring 20 comes into contact with the lower spring 30 at the distance L before the upper spring 20 is fully inverted at the distance s2. Thereafter, applying an operation load deforms both the upper spring 20 and the lower spring 30. At this time, the operation load applied to the push switch 1 serves as a synthetic load of the upper spring 20 and the lower spring 30.

(b) of FIG. 5 represents the relationship between the stroke and the synthetic operation load of the upper spring 20 and the lower spring 30. The push switch 1 is set such that when the upper spring 20 comes into contact with the lower spring 30 at the distance L and then deforms up to a distance s3, the upper spring 20, the lower spring 30, and the substrate 10 come into contact with each other at the central portion of the substrate 10. In the interval from the distance L to the distance s3, as indicated by an arrow in (b) of FIG. 5, applying an operation load deforms both the upper spring 20 and the lower spring 30 so that the operation load increases moderately for the stroke. In other words, with the push switch 1, there exists an interval in which the first fixed contact point and the second fixed contact points establish conduction to each other upon inversion of the upper spring 20 and then both the upper spring 20 and the lower spring 30 deform so that the operation load increases moderately. Therefore, the operator can experience a softer sensation than in the push switch 100 with no lower spring 30.

With the push switch 1, although the upper spring 20 comes into contact with the lower spring 30 before complete inversion of the upper spring 20 (L<s2), the distance between the upper spring 20 and the lower spring 30 may be set such that the upper spring 20 comes into contact with the lower spring 30 after full inversion of the upper spring 20 (L≥s2). Even when L≥s2, since there exists an interval in which both the upper spring 20 and the lower spring 30 deform so that the operation load increases moderately, the operator of the push switch can experience a softer sensation.

Figure 6:
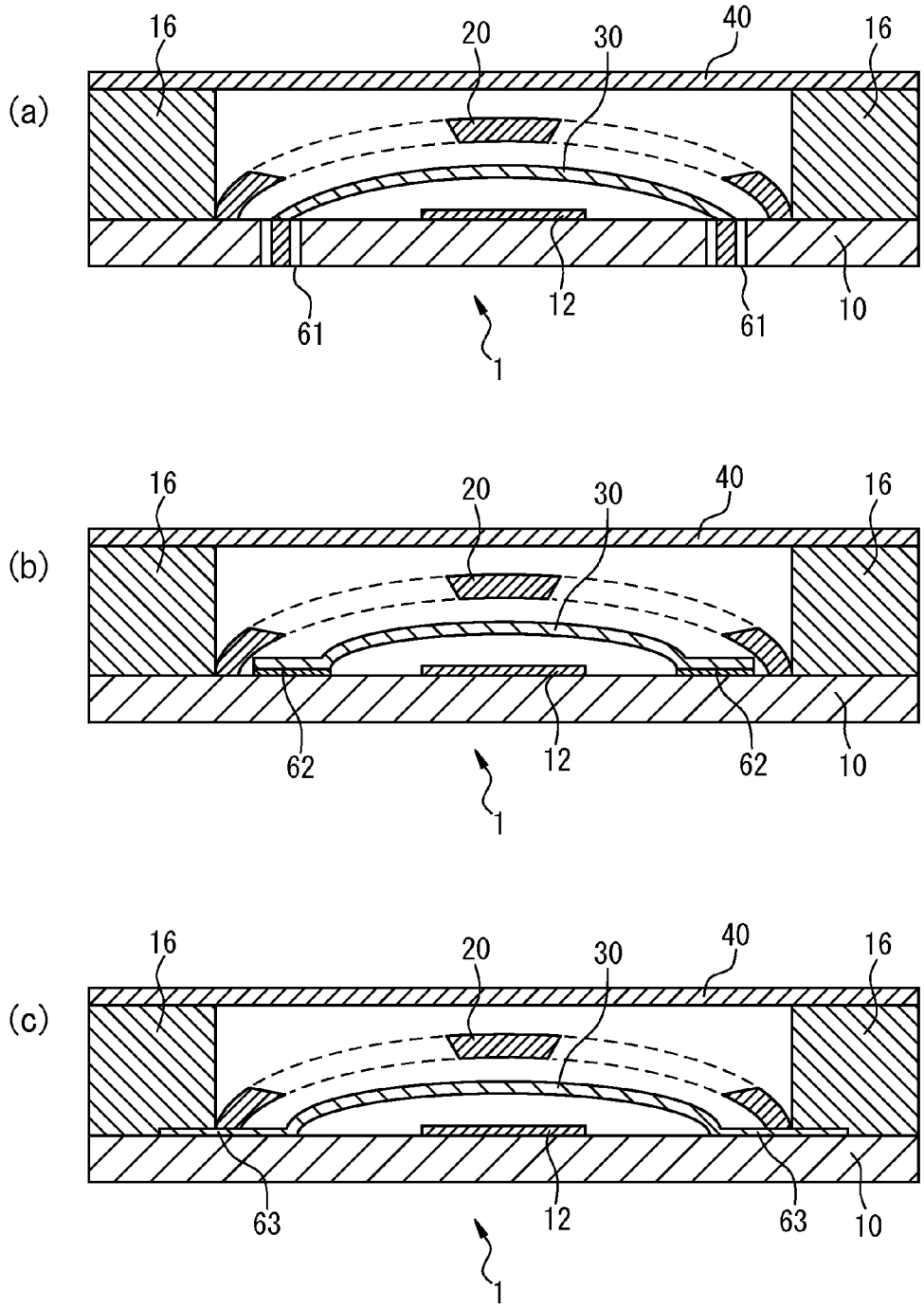
FIG. 6 illustrates, in (a) through (c), sectional views for explaining three other methods for fixing the lower spring 30 in position.

(a) through (c) of FIG. 6 are sectional views for explaining three other methods for fixing the lower spring 30 in position. The lower spring 30 is fixed to the substrate 10 through the adhesive sheet 18 in the push switch 1 depicted as FIG. 1, but may also be fixed to the substrate 10 using other methods, as illustrated in (a) to (c) of FIG. 6.

With the method represented in (a) of FIG. 6, holes 61 are formed in the substrate 10 at the two longitudinal ends of the lower spring 30. In this case, the lower spring 30 is fixed to the substrate 10 by bending the two ends of the lower spring 30 and inserting them to the holes 61. In the method illustrated in (a) of FIG. 6, the lower spring 30 may further be fixed to the adhesive sheet 18, as depicted in (b) of FIG. 4, or no adhesive sheet 18 may be provided.

With the method represented in (b) of FIG. 6, the lower spring 30 is fixed to the substrate 10 using a conductive paste 62 at the two longitudinal ends of the lower spring 30. In the method illustrated in (b) of FIG. 6, the lower spring 30 can be fixed in position even with no adhesive sheet 18.

With the method represented in (c) of FIG. 6, two longitudinal ends 63 of the lower spring 30 are clamped between the substrate 10 and the mold frame 16. In the method illustrated in (c) of FIG. 6, the lower spring 30 can be fixed even with no adhesive sheet 18.

Figure 7:
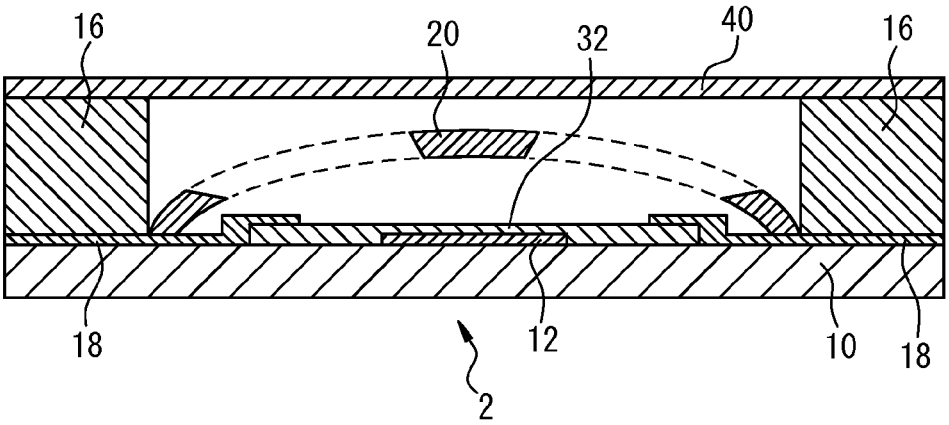
FIG. 7 is a sectional view illustrating another push switch 2.

FIG. 7 is a sectional view illustrating another push switch 2, similar to that illustrated as (b) of FIG. 4. The push switch 2 is different from the push switch 1 in terms of including conductive rubber 32 mounted on a substrate 10 to cover a first fixed contact point 12, in place of the lower spring 30. Other features of the push switch 2 are the same as in the push switch 1.

Since the conductive rubber 32 is conductive, bringing, by pressing and inversion, an upper spring 20 into contact with the conductive rubber 32 establishes conduction between the first fixed contact point 12 and second fixed contact points 14 and thereby turns on the switch. After the upper spring 20 comes into contact with the conductive rubber 32, further pressing the upper spring 20 deforms the conductive rubber 32 and therefore increases the stroke of the push switch 2, as in the push switch 1. The conductive rubber 32 exemplifies a buffer member disposed below the movable member.

Figure 8:
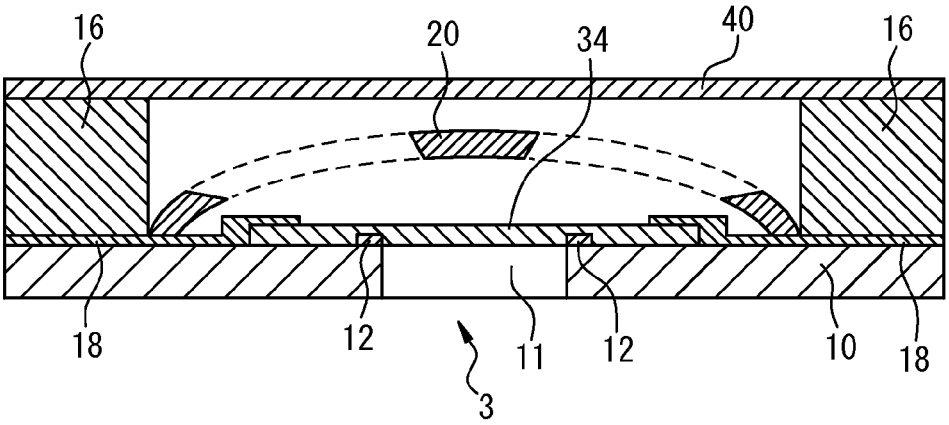
FIG. 8 is a sectional view illustrating still another push switch 3.

FIG. 8 is a sectional view illustrating still another push switch 3, similar to that illustrated as (b) of FIG. 4. The push switch 3 is different from the push switch 1 in terms of including a substrate 10 provided with a through hole 11 at its central portion, first fixed contact points 12 disposed around the through hole 11, and, in place of the lower spring 30, a leaf spring 34 mounted on the substrate 10 to cover the through hole 11 and the first fixed contact points 12. Other features of the push switch 3 are the same as in the push switch 1. The central portion of the substrate 10 is a portion with which an upper spring 20 comes into contact upon the inversion of the dome shape of the upper spring 20.

Since the leaf spring 34 is conductive, bringing, by pressing and inversion, the upper spring 20 into contact with the leaf spring 34 establishes conduction between the first fixed contact points 12 and second fixed contact points 14 and thereby turns on the switch. After the upper spring 20 comes into contact with the leaf spring 34, further pressing the upper spring 20 bends the leaf spring 34 inwards within the through hole 11 and therefore increases the stroke of the push switch 3, as in the push switch 1. The leaf spring 34 exemplifies a buffer member disposed below the movable member.

In place of the through hole 11, an indentation (step) may be formed on the upper surface of the substrate 10 at its central portion. In this case, since the leaf spring 34 bends inwards within the indentation, the same effect as in the use of the through hole 11 can be obtained.

Figure 9:
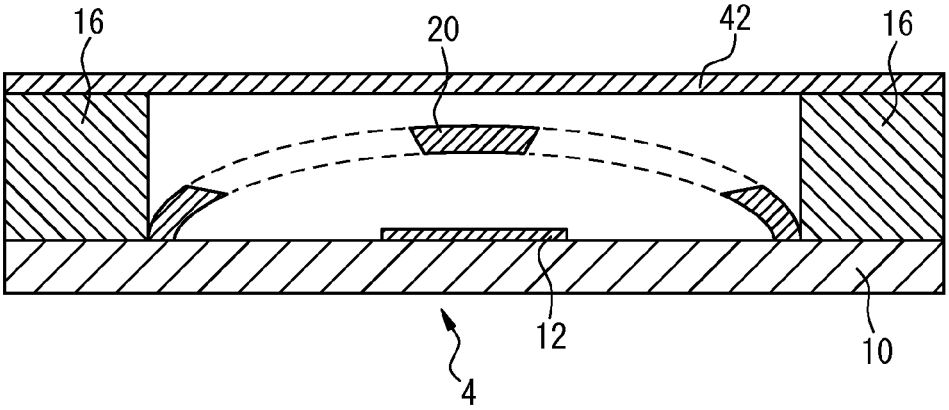
FIG. 9 is a sectional view illustrating still another push switch 4.

FIG. 9 is a sectional view illustrating still another push switch 4, similar to that illustrated as (b) of FIG. 4. The push switch 4 is different from the push switch 1 in terms of including no lower spring 30 and, in place of the protective sheet 40, an elastic protective sheet 42. Other features of the push switch 4 are the same as in the push switch 1. The protective sheet 42 is made of, for example, a synthetic resin having a given plasticity.

With the push switch 4, the protective sheet 42 is elastic and therefore contracts by pressing, before the start of deformation of the upper spring 20. This can increase the stroke of the push switch 4 as in the push switch 1 even with no lower spring 30. The protective sheet 42 exemplifies a buffer member disposed above the movable member.

The elastic protective sheet 42 may substitute for the protective sheet 40 in each of the push switches 1 to 3 as well. This provides a double member for adjusting the operation load, thus further increasing the stroke, compared to the push switches 1 to 3.

Figure 10:
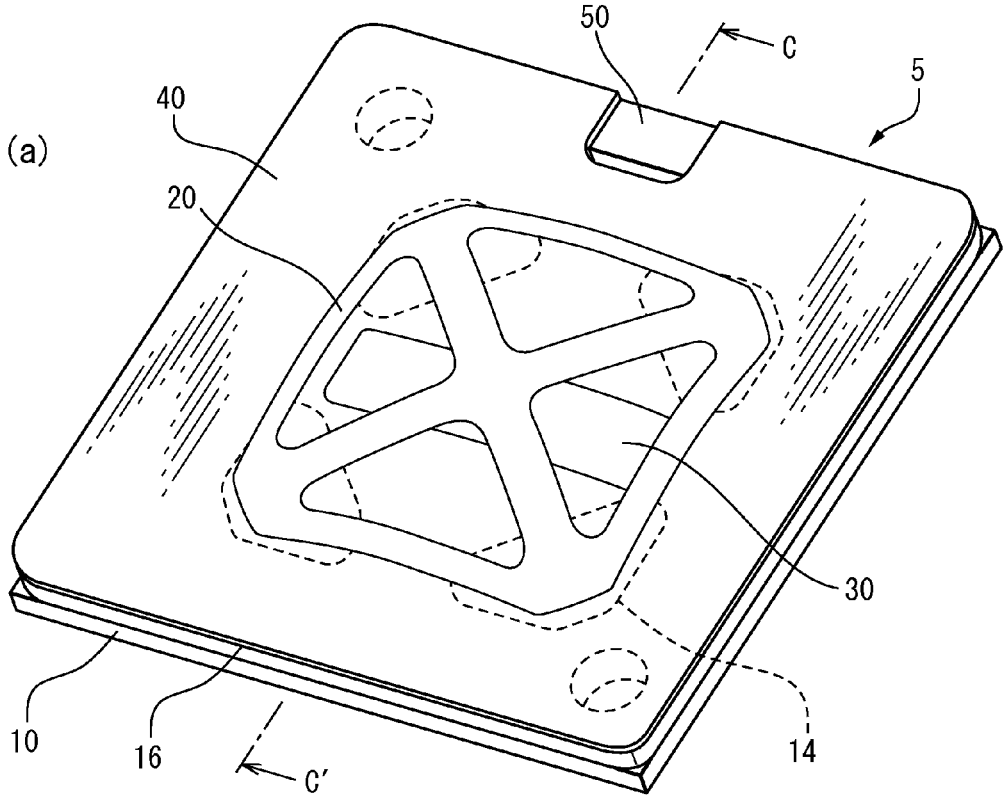
FIG. 10 illustrates in (a), a perspective view of still another push switch 5, and in (b), a sectional view taken along a line C-C' in (a) of FIG. 10.
Figure 10:
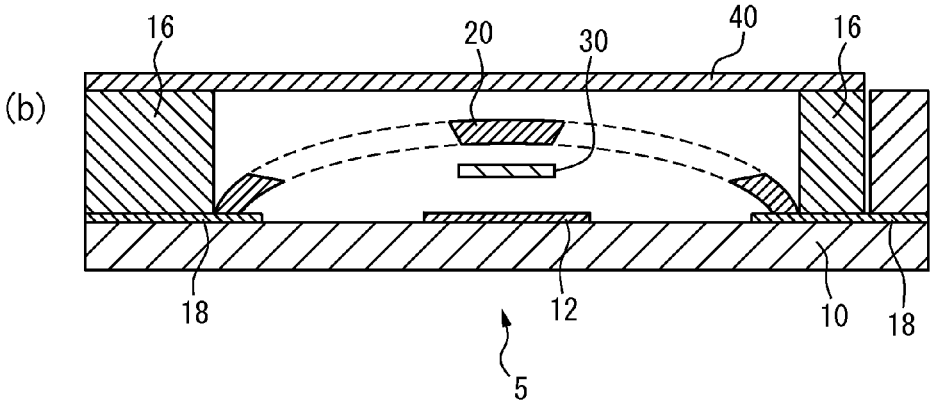

FIG. 10 illustrates in (a), a perspective view of still another push switch 5, and in (b), a sectional view taken along a line C-C' in (a) of FIG. 10.

The push switch 5 is different from the push switch 1 in terms of partially cutting the outer peripheral portions of a mold frame 16 and a protective sheet 40 and placing an LED 50 at the cut position. Other features of the push switch 5 are the same as in the push switch 1.

The push switch 5 is a light-emitting switch enabled to emit light as a whole by guiding light into the mold frame 16 and the protective sheet 40 using the LED 50. The LED 50 may be activated only when the push switch 5 is turned on, to indicate to that effect. Alternatively, the LED 50 may be activated regardless of ON/OFF of the switch, to enable the push switch 5 to be used even under dark environments.

Figure 11:
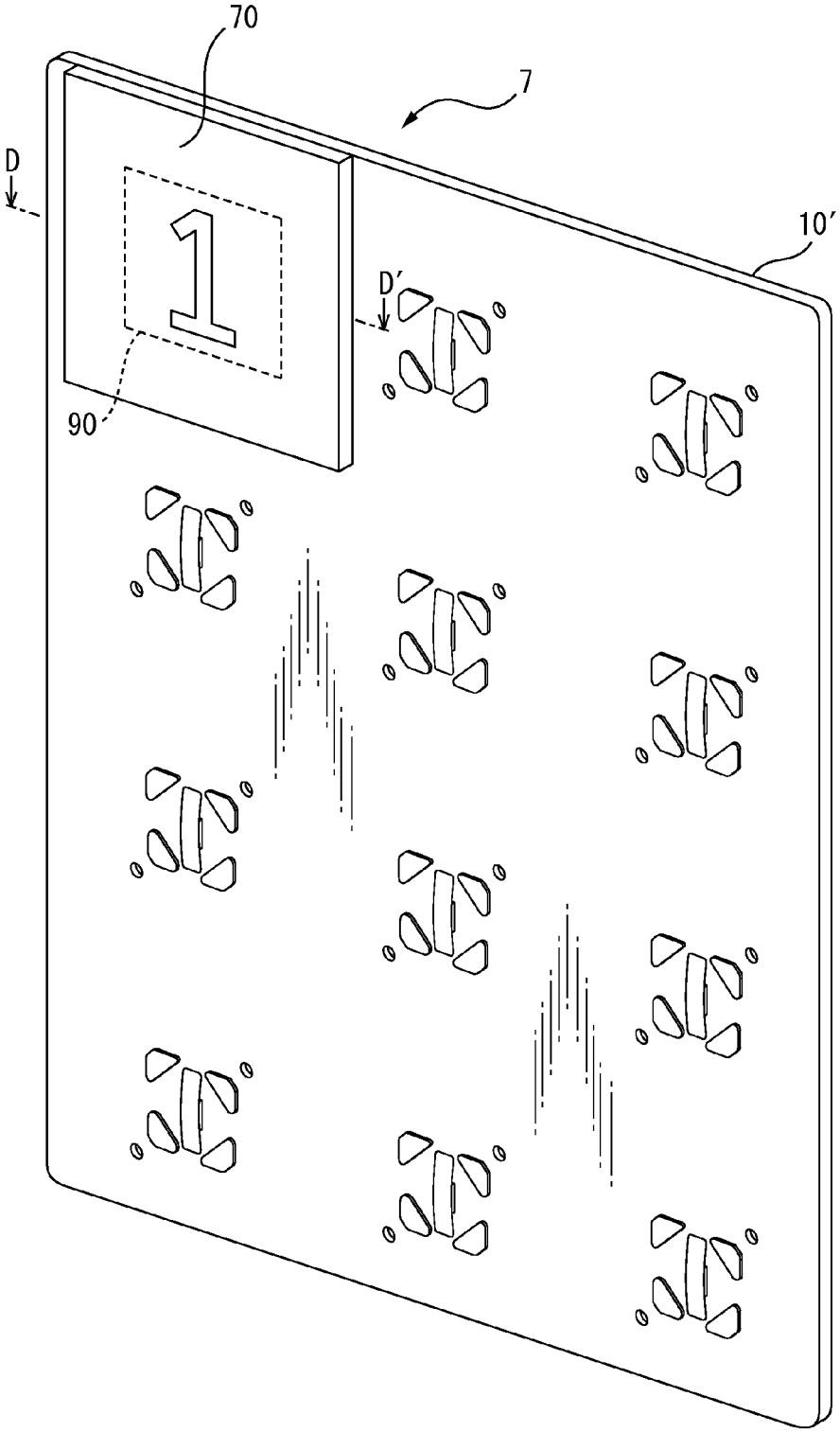
FIG. 11 is a perspective view illustrating a switch module 7.
Figure 12:
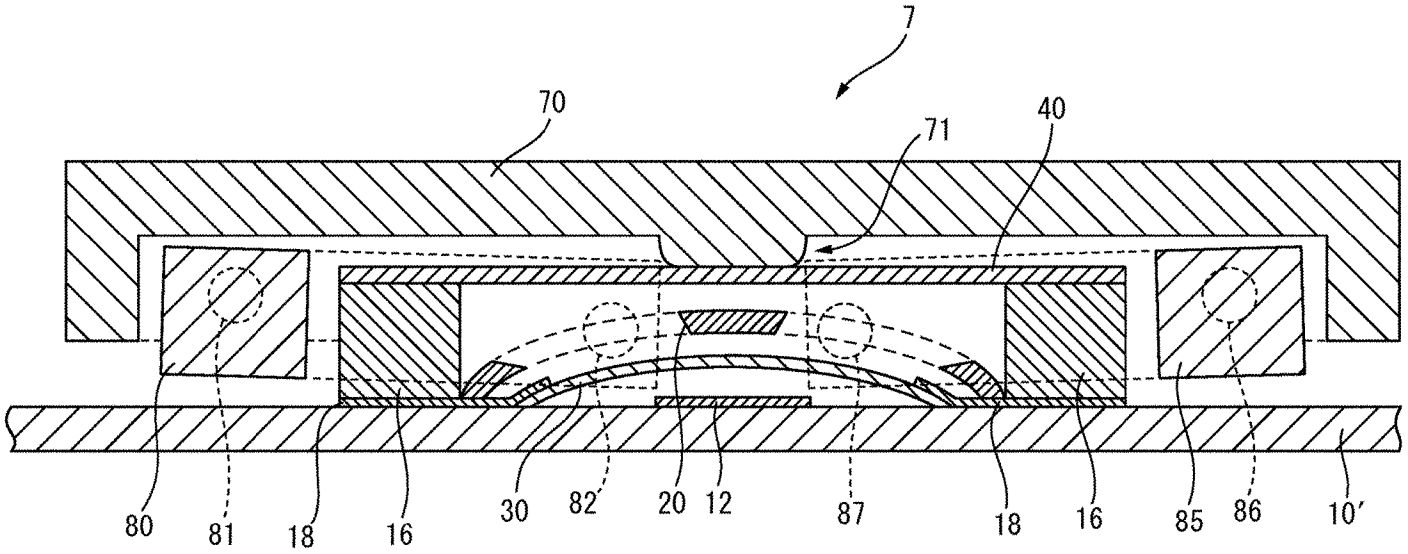
FIG. 12 is a sectional view taken along a line D-D' in FIG. 11.

FIG. 11 is a perspective view illustrating a switch module 7, and FIG. 12 is a sectional view taken along a line D-D' in FIG. 11. Referring to FIGS. 11 and 12, the same reference numerals denote the same components as in the push switch 1 depicted as FIGS. 1 to 4, and a description thereof will not be given.

The switch module 7 includes twelve sets of switch structures 70, similar to the push switch 1, formed on a common substrate 10' for use in, for example, a numeric keypad for a portable terminal. Switch frames 80 and 85 and a switch pad 90 are disposed on each switch structure 70. FIG. 11 illustrates only the switch pad 90 for "1" for the sake of convenience and omits an illustration of other switch pads to make the common substrate 10' observable. Switch pads "2" to "9," "0," "#," and "*," for example, are not illustrated herein.

The switch structure 70 includes a first fixed contact point 12, a pair of first electrodes 13*a* and 13*b*, second fixed contact points 14, a pair of second electrodes 15*a* and 15*b*, an adhesive sheet 18, an upper spring 20, a lower spring 30, a mold frame 16, and a protective sheet 40. In other words, the switch structure 70 includes all parts other than the substrate 10 in the push switch 1. Recesses corresponding to projections of the switch frames 80 and 85 are formed in the mold frame 16 of the switch structure 70, as will be described later.

The switch frames 80 and 85 serve as components which connect the switch structure 70 and the switch pad 90 to each other. The switch frame 80 includes projections 82 and 84 to fit into the switch structure 70, and projections 83 and 81 to fit into the switch pad 90. The switch frame 85 includes projections 87 and 89 to fit into the switch structure 70, and projections 86 and 88 to fit into the switch structure 70.

The switch pad 90 includes a pressing unit 91 which is made of, for example, a resin and projects inwards. The pressing unit 91 is disposed in a portion corresponding to the central portion of the upper spring 20. When the user presses the switch pad 90, an operation load is applied to the upper spring 20 and the lower spring 30. Recesses corresponding to the projections of the switch frames 80 and 85 are formed in the switch pad 90. The sectional view illustrated as FIG. 12 represents a state before the switch pad 90 is pressed.

Figure 13:
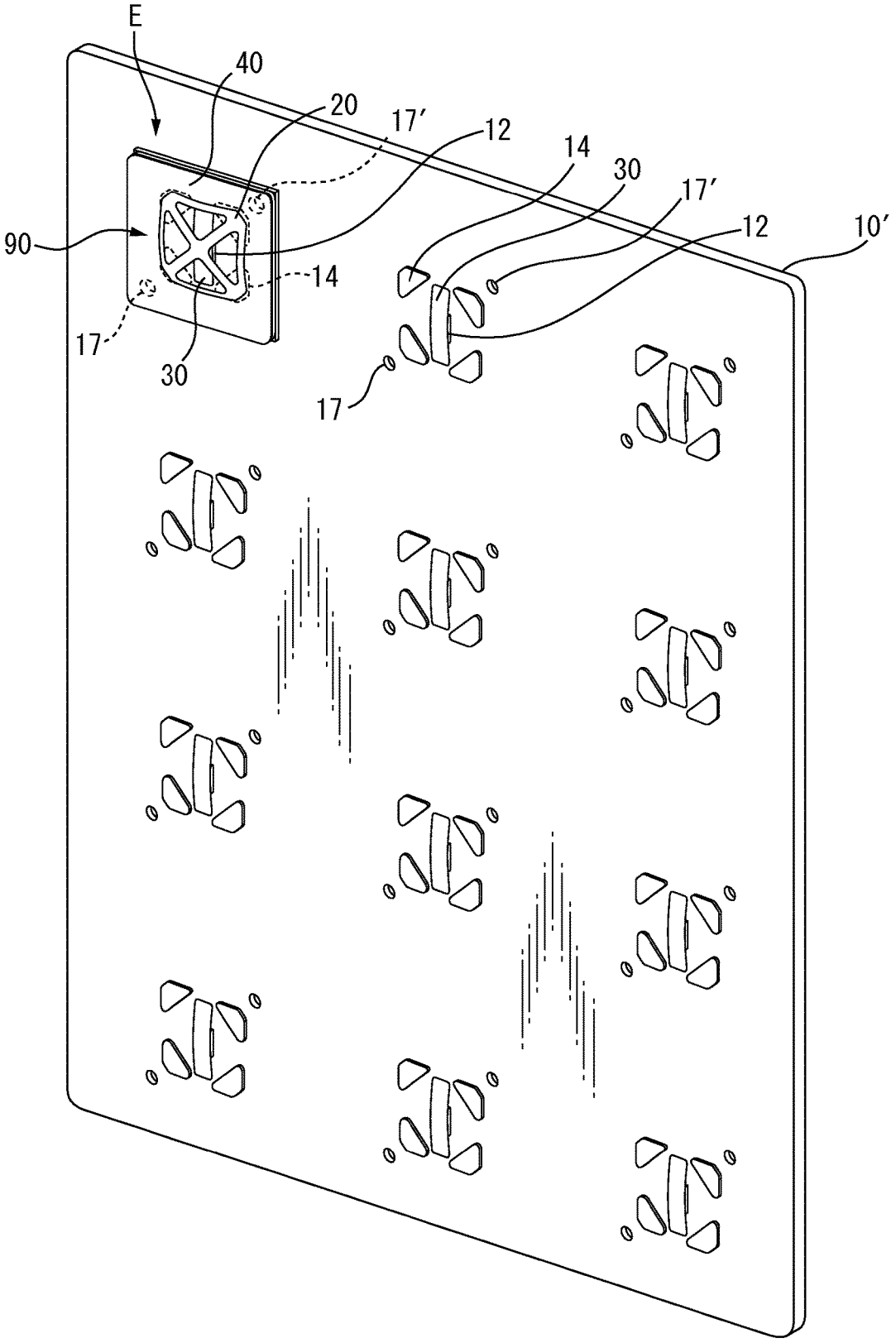
FIG. 13 is a perspective view (1) for explaining the process of manufacturing a switch module 7.
Figure 14:
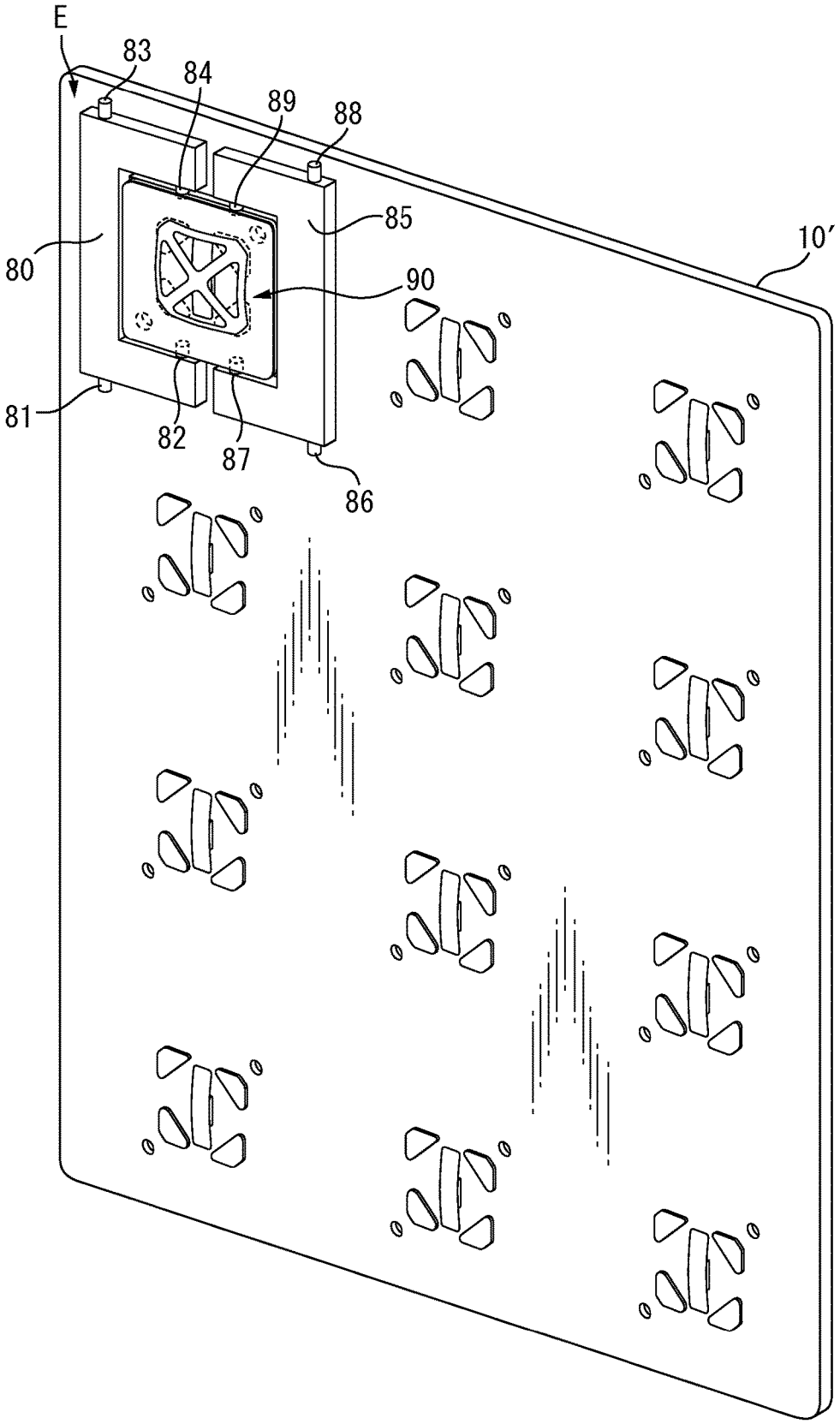
FIG. 14 is a perspective view (2) for explaining the process of manufacturing a switch module 7.
Figure 15:
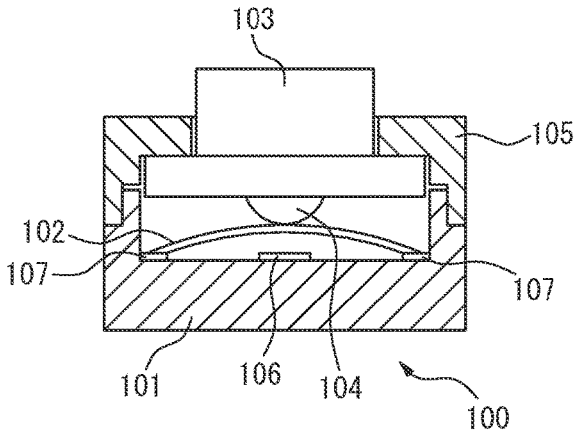
FIG. 15 PRIOR ART
FIG. 15 is a sectional view illustrating a conventional push switch 100.
Figure 16:
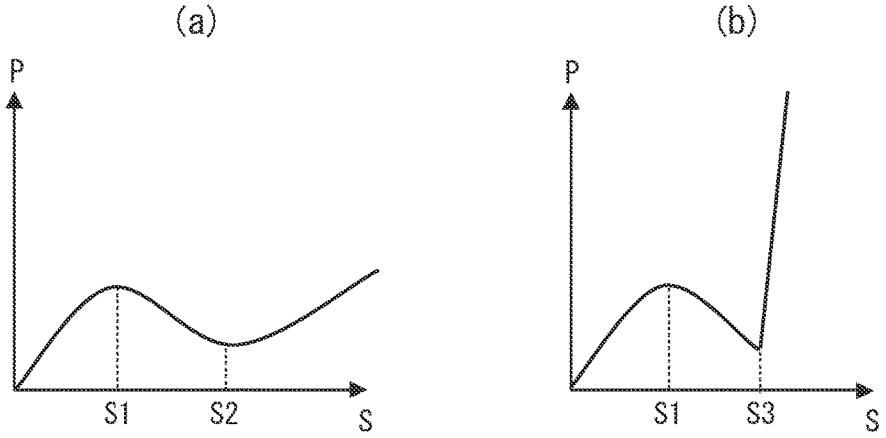
FIG. 16 PRIOR ART
FIG. 16 illustrate graphs each for explaining the relationship between the operation load applied to the push switch 100 and the amount of deformation (stroke) of the movable member.

FIGS. 13 and 14 are perspective views for explaining the process of manufacturing a switch module 7.

First, twelve sets of configurations each including a first fixed contact point 12, four second fixed contact points 14, and holes 17 and 17' are formed on a common substrate 10', and lower springs 30 are disposed on the first fixed contact points 12. This state corresponds to portions other than the switch pad 90 depicted in FIG. 11. Although not illustrated, twelve sets of configurations each including a pair of first electrodes 13*a* and 13*b* electrically connected to the first fixed contact point 12, and a pair of second electrodes 15*a* and 15*b* electrically connected to the second fixed contact points 14 are formed on the bottom surface of the common substrate 10'.

Next, the lower springs 30 and mold frames 16 are bonded onto the common substrate 10' through adhesive sheets 18. Further, within spaces defined inside the mold frames 16, upper springs 20 are disposed above the lower springs 30 and protective sheets 40 are bonded to the upper surfaces of the mold frames 16. This state is represented as a portion E corresponding to the switch pad 90 in FIG. 13.

Next, projections 82, 84, 87, and 89 of switch frames 80 and 85 are fitted into recesses formed in the mold frames 16. This state is represented as a portion F corresponding to the switch pad 90 in FIG. 14.

Lastly, the projections 81, 83, 86, and 88 of the switch frames 80 and 85 are fitted into recesses formed in the switch pad 90. This state corresponds to the switch pad 90 represented in FIG. 11. For other keys (for example, "2" to "9," "0," "#," and "*") as well, switch pads are similarly finished to complete the switch module 7. Twelve sets of switch structures 70 formed in the switch module 7 each have a configuration similar to that of the above-mentioned push switch 1, and can therefore convey a softer sensation to the user upon pressing, as in the push switch 1.

Although in the above-described switch module 7, a plurality of switch structures 70 each corresponding to the aforementioned push switch 1 are arranged on the common substrate 10', a switch module may be formed by arranging, on the common substrate 10', switch structures corresponding to the above-described other push switches 2 to 5. Further, instead of including all configurations other than the substrate 10 of the push switch 1, the switch structures 70 may include only some of them or additionally include other configurations.

In the above-mentioned switch module 7, twelve switch pads are formed on the common substrate 10' for use in, for example, a numeric keypad for a portable terminal. However, for example, more or fewer switch pads may be formed on the common substrate 10' for use in a PC keyboard or operation input to other devices.

In the above-mentioned switch module 7, the switch frames 80 and 85 are employed to connect the switch structure 70 and the switch pad 90 to each other. However, the member disposed on the switch structure 70 is not limited to the switch pad 90, and a wide variety of pressing members having different configurations and shapes may be used. Connection between any of the aforementioned wide variety of pressing members and the switch structure 70 is not limited to the use of the switch frames 80 and 85, and may be carried out using other methods.

REFERENCE SIGNS LIST

1, 2, 3, 4, 5 push switch
7 switch module
10 substrate
12 first fixed contact point
14 second fixed contact point
16 mold frame
18 adhesive sheet
20 upper spring
30 lower spring
32 conductive rubber
34 leaf spring
40, 42 protective sheet
50 LED
70 switch structure
80, 85 switch frame
90 switch pad

What is claimed is:

1. A push switch comprising:
a substrate;
a first fixed contact point disposed on a surface of the substrate;
a second fixed contact point disposed around the first fixed contact point on the surface of the substrate;
a convex dome-shaped movable member disposed on the surface of the substrate so that an end part of the movable member is in contact with the second fixed contact point, the movable member being pressed so as to invert the dome shape and thereby establish conduction between the first fixed contact point and the second fixed contact point; and
a buffer member disposed between the movable member and the substrate so as to cover the first fixed contact point without being in contact with any one of fixed contact points when the buffer member is not pressed through the movable member, the buffer member adjusting an operation load applied to the movable member during inversion of the dome shape,
wherein the buffer member is a leaf spring interposed between the substrate and the movable member to cover the first fixed contact point.

2. The push switch according to claim 1, wherein
the substrate includes one of a through hole and an indentation in a portion with which the movable member comes into contact upon the inversion of the dome shape,
the first fixed contact point is disposed around the one of the through hole and the indentation, and
the buffer member is a leaf spring mounted on the substrate to cover the first fixed contact point and the one of the through hole and the indentation.

3. The push switch according to claim 1, further comprising an elastic protective sheet which covers the movable member.

4. The push switch according to claim 1, wherein the buffer member adjusts a change in the operation load for an amount of deformation of the movable member after establishment of the conduction between the first fixed contact point and the second fixed contact point.

5. A switch module comprising:
a common substrate; and
a plurality of switch structures formed on the common substrate,
the plurality of switch structures each comprising:
a first fixed contact point disposed on a surface of the common substrate;
a second fixed contact point disposed around the first fixed contact point on the surface of the common substrate;
a convex dome-shaped movable member disposed on the surface of the common substrate so that an end part of the movable member is in contact with the second fixed contact point, the movable member being pressed so as to invert the dome shape and thereby establish conduction between the first fixed contact point and the second fixed contact point; and
a buffer member disposed between the movable member and the common substrate so as to cover the first fixed contact point without being in contact with any one of fixed contact points when the buffer member is not pressed through the movable member, the buffer member adjusting an operation load applied to the movable member during inversion of the dome shape,
wherein the buffer member is a leaf spring interposed between the common substrate and the movable member to cover the first fixed contact point.

6. The switch module according to claim 5, wherein
the common substrate includes one of a through hole and an indentation in a portion with which the movable member comes into contact upon the inversion of the dome shape,
the first fixed contact point is disposed around the one of the through hole and the indentation, and
the buffer member is a leaf spring mounted on the common substrate to cover the first fixed contact point and the one of the through hole and the indentation.

7. The switch module according to claim 5, further comprising an elastic protective sheet which covers the movable member.

8. The switch module according to claim 5, wherein the buffer member adjusts a change in the operation load for an amount of deformation of the movable member after establishment of the conduction between the first fixed contact point and the second fixed contact point.

* * * * *